United States Patent [19]

Chang

[11] 3,976,436

[45] Aug. 24, 1976

[54] METAL OF IMPROVED ENVIRONMENTAL RESISTANCE

[75] Inventor: David R. Chang, Cincinnati, Ohio

[73] Assignee: General Electric Company, Cincinnati, Ohio

[22] Filed: Feb. 13, 1975

[21] Appl. No.: 549,769

[52] U.S. Cl. ..... 29/196.6; 29/194; 75/124; 75/170; 75/171

[51] Int. Cl.[2] ..... B32B 15/00; C22C 19/05

[58] Field of Search ..... 75/170, 171, 134 F; 29/194, 196.6

[56] References Cited

UNITED STATES PATENTS 3,528,861 9/1970 Elam et al. ..... 148/11.5 F 3,918,139 11/1975 Felten ..... 75/171

*Primary Examiner*—Arthur J. Steiner

*Attorney, Agent, or Firm*—Lee H. Sachs; Derek P. Lawrence

[57] ABSTRACT

An alloy based on Fe, Co or Ni, and including Al, is provided with improved environmental resistance through the inclusion in the composition of the combination of 0.1–10 weight percent Hf and 0.5–20 wt. % of an element selected from Pt, Rh and Pd. The combination is particularly useful in providing an article coated with such alloy.

5 Claims, No Drawings

METAL OF IMPROVED ENVIRONMENTAL RESISTANCE

The invention herein described was made in the course of or under a contract, or a subcontract thereunder, with the U.S. Department of the Navy.

CROSS-REFERENCE TO RELATED INVENTIONS

This invention is related to patent application Ser. No. 521,860, filed Nov. 7, 1974 for metallic coating and article with improved resistance to high temperature environmental conditions, and assigned to the assignee of the present invention.

BACKGROUND OF THE INVENTION

This invention relates to metallic materials of improved environmental resistance particularly at elevated temperatures, and, more particularly, to such materials in the form of a metallic coating applied to a metal article for high temperature application.

Designers of power generation apparatus, such as the gas turbine engine, are interested in improving the temperature capability of high temperature operating components. Although modern alloys have mechanical properties which can withstand the force conditions experienced in such application, some have surface stability in respect to oxidation or hot corrosion resistance less than that which is desirable.

A major effort associated with the development of gas turbine engines is the effort to develop improved high temperature coating alloys and coated articles. Thus, there has been reported a variety of coatings, coated articles and coating methods for such application. One reported example of a pack diffusion process, and alloy useful in such a process, is represented by U.S. Pat. No. 3,667,985 — Levine et al., issued June 6, 1972. The vapor deposition of high temperature coatings, including aluminum as an important ingredient, is shown in one form in U.S. Pat. No. 3,528,861 — Elam et al. issued Sept. 15, 1970. Associated with such methods has been the invention of the above-identified copending application Ser. No. 521,860 for an improved coating and article having improved resistance to high temperature environmental conditions through incorporation of the element Hf in a defined range. Such patents as U.S. Pat. Nos. 3,494,748 — Todd; 3,677,789 — Bungardt et al. and 3,819,338 — Bungardt et al. disclose the inclusion of platinum alone or with certain other elements for improved oxidation resistance. The disclosures of each of these patents and the application are incorporated herein by reference.

SUMMARY OF THE INVENTION

It is a principal object of the present invention to provide a metal of improved environmental resistance which can be used as a coating on a metallic article.

Another object is to provide a metallic article having a surface portion of a metal of improved resistance to environmental conditions.

These and other objects and advantages will be more clearly understood from the following detailed description and the examples, all of which are intended to be typical of rather than limiting in any way on the scope of the present invention.

The alloy associated with the present invention is one based on an element selected from the transition triad elements Fe, Co and Ni, with the alloying addition of Al, the alloy being provided with improved environmental resistance through the inclusion of the combination of 0.1–10 wt. % Hf and 0.5–20 wt. % of an element selected from Pt, Rh and Pd. The alloy is particularly useful in the provision of an article coating by such methods as application of its elements to an article surface followed by diffusion with the surface to create the alloy, by deposition of the complete alloy on an article surface followed by interdiffusion with the surface if desired, and others. A preferred form of the alloy which provides the improved environmental resistance consists essentially of, by weight, 10–50% Cr, 8–30% Al, 0–3% Y, 0.1–10% Hf, 0.5–20% Pt, with the balance essentially Fe, Co or Ni. In such an alloy, it is preferred that the Hf be maintained in the range of about 2–5% and the Pt in the range of about 5–10%. A more specifically preferred form consists essentially of, by weight, 20–30% Cr, 8–20% Al, 0.5–1% Y, 2–5% Hf, 5–10% Pt, with the balance essentially Fe, Co or Ni.

DESCRIPTION OF THE PREFERRED EMBODIMENTS

The alloy associated with the present invention was first evaluated in a crucible test study and comparison with known compositions, some of which have been shown to be useful in the form of coatings for resistance to oxidation or sulfidation or both. In such evaluation for resistance to high temperature reducing and oxidizing environments, pin casting specimens of the alloys shown in the following Table were placed in crucibles including a salt which combined 0.1 wt. % C and 99.9% $Na_2SO_4$ heated in argon for reducing conditions and in air for oxidizing conditions at about 1650°F (900°C). The following Table also includes the reducing environment data on deterioration of each example in hours per mil of thickness.

TABLE

| Example | Specimen Composition (wt. %) | C & $Na_2SO_4$ at 1650°F (hrs/mil) |
|---|---|---|
| 1 | Co Base (a) | 260 |
| 2 | Co Base, 1 Y | 250 |
| 3 | Co Base, 2–5 Hf | 2000 |
| 4 | Co Base, 1 Y, 5–10 Pt | 2000 |
| 5 | Co Base 2–5 Hf, 5–10 Pt | 2500 |
| 6 | Fe Base (b) | 20 |
| 7 | Fe Base, 2–5 Hf | 800 |
| 8 | Fe Base, 1 Y, 5–10 Pt | 1300 |
| 9 | Fe Base, 2 Hf, 5–10 Pt | 2000 |

(a) 25% Cr, 10% Al, balance Co
(b) 25% Cr, 10% Al, balance Fe

Representing the alloy associated with the present invention in the above Table are examples 5 and 9 which exhibited a significantly improved resistance to deterioration when compared with other examples. Thus, examples 5 and 9 are typical of the improvement achievable in an alloy based on a transition triad element Fe, Co or Ni, in the composition of which has been included Al, Hf in the range of 0.1–10 wt. % and an element selected from Pt, Rh and Pd in the range of 0.5–20 wt. %. Such examples are particularly exemplary of the preferred form of a Co-base or Fe-base alloy including both Cr and Al along with 2–5 wt. % Hf and 5–10 wt. % Pt. In the oxidation environment testing, it was found that the present invention affords good protection, providing significant improvement over such alloy forms as are represented by examples 1 and 6. In $Na_2SO_4$ in air at 1650°F (900°C), examples 1 and 6 recorded 1500 hrs/mil each whereas example 5 recorded 4000 hrs/mil and example 9 recorded 3200 hrs/mil.

The alloy associated with the present invention can be generated as a coating portion of an article in a number of ways. Some of such approaches have been described in the above-identified copending application Ser. No. 521,860, the disclosure which has been incorporated herein by reference. Use of such methods with the present invention include the application of the combination of Hf and Pt to an alloy based on one of the transition triad elements and which already includes appropriate amounts of Cr and Al to generate the surface portion and the article associated with the present invention. Other methods include the combination of the deposition of Hf and Pt, according to the present invention, and aluminiding by one of the variety of methods currently known and widely used in the art, as described in the above-identified copending application.

Resulting from use of the present invention is an article having a surface portion of improved environmental resistance, the surface portion based on Fe, Co or Ni and including Al and the combination of 0.1–10 wt. % Hf and 0.5–20 wt. % Pt, Rh or Pd. The advantages of improved oxidation scale resistance and stability of the combination of $Al_2O_3$ in combination with $HfO_2$, the latter which causes keying or interlocking of the oxide surface, has been shown in the above-identified copending application. Such advantages were attributed to the use of Hf in the composition. It has been recognized through the present invention that the element Pt, representative of the related elements Pt, Rh and Pd, increases the Al activity and further stabilizes the oxide scale.

The present invention, as shown in the above Table, provides an additional dimension of improved environmental resistance particularly to such currently used nickel-base superalloys as Rene' 80 alloy consisting nominally, by weight, of 0.15% C, 14% Cr, 5% Ti, 0.15% B, 3% Al, 4% W, 4% Mo, 9.5% Co, 0.06% Zr, with the balance Ni and incidental impurities or to X-40 alloy consisting nominally, by weight, of 0.5% C, 25% Cr, 7.5% W, 10.5% Ni with the balance essentially Co and incidental impurities. The present invention can be used with such alloys to provide an article of improved environmental resistance through one or more of the above-described coating methods.

Although the present invention has been described in connection with some typical and representative examples, such presentations are not intended in any way to limit the scope of the present invention. It is intended to define such invention in the appended claims.

What is claimed is:

1. A metallic article comprising a substrate selected from the group consisting of Fe, Co and Ni base alloys, said substrate having diffused thereon an alloy consisting essentially of, by weight, 8–30% Al, 0.1–10% Hf, 0.5–20% of an element selected from the group consisting of Pt, Rh and Pd, up to 3% Y and the balance an element selected from the group consisting of Ni and Co.

2. The article of claim 1 which includes, in addition, by weight, 10–50% Cr.

3. The article of claim 2 consisting essentially of, by weight, 20–30% Cr, 8–20% Al, 0.5–1% Y, 2–5% Hf, 5–10% Pt with the balance of an element selected from the group consisting of Co and Ni.

4. The article of claim 2 wherein the balance of the diffused alloy is Co.

5. The article of claim 3 wherein the balance of the diffused alloy is Ni.

* * * * *

UNITED STATES PATENT OFFICE

CERTIFICATE OF CORRECTION

PATENT NO. : 3,976,436

DATED : August 24, 1976

INVENTOR(S) : David R. Chang

It is certified that error appears in the above-identified patent and that said Letters Patent are hereby corrected as shown below:

Column 4, line 26, claim 2, after "1" insert --in--;
after "which" insert --the diffused alloy--.

Column 4, line 28, claim 3, after "2" insert --in which the diffused alloy--;
change "consisting" to --consists--.

Signed and Sealed this

Twenty-first Day of June 1977

[SEAL]

*Attest:*

RUTH C. MASON
*Attesting Officer*

C. MARSHALL DANN
*Commissioner of Patents and Trademarks*